US008234977B2

(12) United States Patent
Armstrong

(10) Patent No.: US 8,234,977 B2
(45) Date of Patent: Aug. 7, 2012

(54) APPARATUS FOR AIDING THE CONTAINMENT AND TRANSPORT OF VARIOUS ARTICLES

(76) Inventor: Jerry L. Armstrong, Herford, AZ (US)

( * ) Notice: Subject to any disclaimer, the term of this patent is extended or adjusted under 35 U.S.C. 154(b) by 381 days.

(21) Appl. No.: 12/658,308

(22) Filed: Feb. 12, 2010

(65) Prior Publication Data

US 2011/0126724 A1 Jun. 2, 2011

Related U.S. Application Data

(60) Provisional application No. 61/265,300, filed on Nov. 30, 2009.

(51) Int. Cl.
*B30B 9/00* (2006.01)

(52) U.S. Cl. ..... 100/227; 100/59; 100/61; 100/100; 100/265; 220/495.08; 220/908

(58) Field of Classification Search ..... 100/54, 100/55, 59, 61, 100, 227, 229 A, 245, 265; 220/578, 263, 908, 908.1, 495.08
See application file for complete search history.

(56) References Cited

U.S. PATENT DOCUMENTS

| | | | | |
|---|---|---|---|---|
| 1,234,577 | A * | 7/1917 | Squire | 100/54 |
| 2,384,709 | A * | 9/1945 | Thoren | 220/495.08 |
| 3,734,340 | A * | 5/1973 | Ippolito et al. | 141/391 |
| 3,885,467 | A * | 5/1975 | Merkin | 100/229 A |
| 3,890,890 | A * | 6/1975 | Hennells | 100/48 |
| 4,275,651 | A * | 6/1981 | Groth et al. | 100/229 A |
| 6,860,094 | B1 * | 3/2005 | Abrams | 56/202 |
| 2007/0209529 | A1 * | 9/2007 | Poss et al. | 100/43 |

* cited by examiner

*Primary Examiner* — Jimmy T Nguyen
(74) *Attorney, Agent, or Firm* — Herbert E. Haynes, Jr.

(57) ABSTRACT

A materials handling apparatus for aiding in loading and transporting various materials has three major components, a wheeled cart, a truncated conical cylinder which is carried by the cart and a compaction lid which provide the apparatus with the capability of being operated in three different modes. In the first mode, a conventional trash bag is placed inside the cylinder and the lid can be placed atop the cylinder. In this mode, the apparatus operates as a conventional trash can. In a second mode, the cylinder in placed within a trash bag to protect it from being damaged by materials such as tree and shrub clippings or other materials which could tear the bag. In the third mode no trash bag is used, the materials are loaded into the cylinder, and when loading is complete, the cylinder is lifted off of the materials for direct deposit into a disposal site.

5 Claims, 3 Drawing Sheets

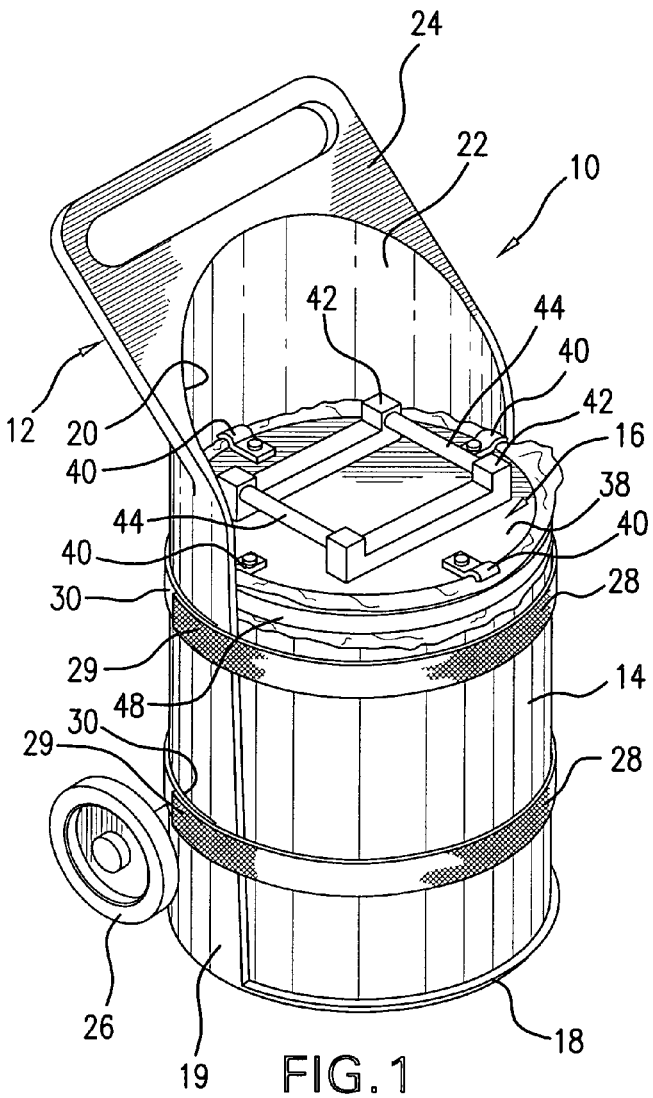
FIG. 1
FIG. 2
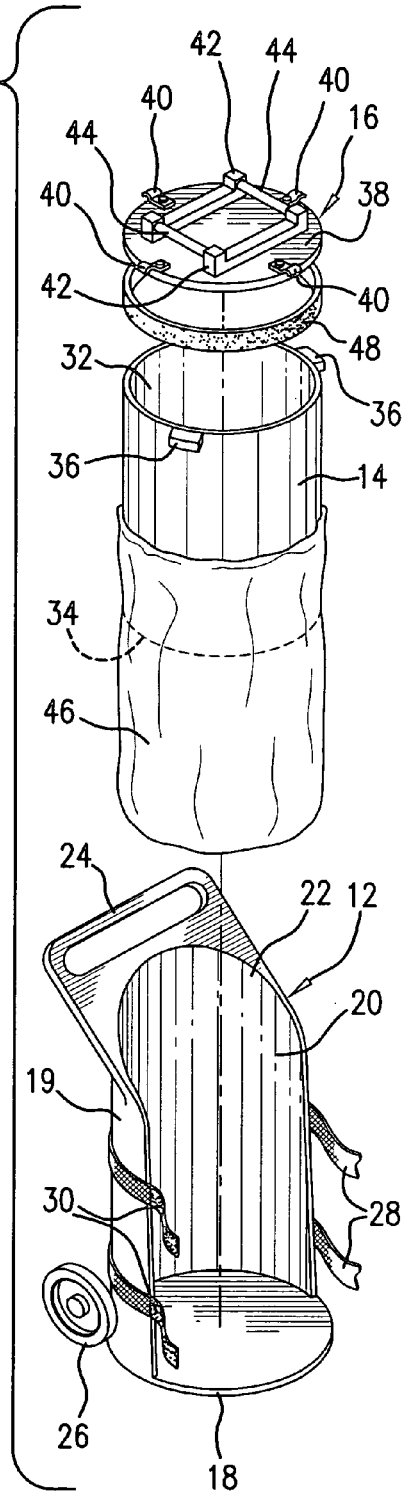

APPARATUS FOR AIDING THE CONTAINMENT AND TRANSPORT OF VARIOUS ARTICLES

CROSS-REFERENCE TO RELATED APPLICATION

This application claims priority from U.S. Provisional Application Ser. No. 61/265,300 filed on Nov. 30, 2009 incorporated herein by reference.

BACKGROUND OF THE INVENTION

1. Field of the Invention

This invention relates in general to transportable containers and more particularly to a materials handling apparatus for facilitating the placement of various articles in containers and transporting of the containerized articles.

2. Description of the Background Art

Although the materials handling apparatus of present invention may be used for handling a large variety of articles, for purposes of this description, the articles to be placed in containers and transported will be described as waste materials such as household refuse, yard and garden trimmings and the like.

Various types of containers have traditionally been used to receive and contain waste materials and in recent times trash bags have come into wide use. Such bags come in various sizes and are most often made of synthetic resin (plastic) and sometimes of they are made of paper. In either case the bags are flimsy and are not self supporting which makes loading waste materials into them difficult unless they are supported is a suitable container. When such trash bags are used inside a home they are usually relatively small and are supported in waste baskets and are therefore well suited for such use. When this type of trash bag is used in commercial establishments, such as a restaurant, they are relatively large and are contained within trash cans.

However, when these bags are used outside such as for yard and garden clean-up they are usually relatively large and can be difficult to use. Most of the time people will struggle to manually hold these larger trash bags upright and open while trying to accomplish the loading operation and this can be a frustrating and often unsuccessful task. About the only time that such a bag loading operation is even reasonably successful is when one person holds the bag while another does the filling.

Another method for loading the larger trash bags is to insert them in a conventional cylindrical garbage can with the upper portion of the bag being folded over the rim of the can to hold the bag in the upright and open position. This method limits the amount of waste material that can be loaded into the bag in that loading an excessive amount of materials into the bag can make its removal from the garbage can difficult due to excessive weight and due to bulging of the sides of the bag into engagement with the interior walls of the can.

Therefore a need exists for a new and useful materials handling apparatus for aiding the containment and transporting of various materials.

SUMMARY OF THE INVENTION

In accordance with the present invention a new and useful materials handling apparatus is disclosed for aiding the loading of various materials, especially waste materials, into trash bags and transporting them between different pickup sites and ultimately to a suitable disposal site.

The materials handling apparatus of the present invention includes three major components, a wheeled cart, a truncated conical cylinder and a compaction lid. The wheeled cart is formed with a base platform from which a body extends upwardly with a semi-circular in cross-section cavity formed therein with the cavity being open at its upper end. The truncated conical cylinder is open at its opposite ends and is removably supported on the base platform of the wheeled cart for positioning within the cavity thereof and is held in the cavity by suitable straps provided on the wheeled cart. The compaction lid is provided with extensible support members which when in the retracted position allows the compaction lid to be moved downwardly into the conical cylinder and when in the extended position will support the lid atop the conical cylinder. The above described major components provide the materials handling apparatus with the capability of being operated in three different modes for aiding in the collection of various materials, especially waste materials.

In a first operational mode a trash bag is placed inside the conical cylinder with its upper end folded over the rim of the cylinder and held in place by an elastic band. The cylinder and trash bag are positioned within the semi-circular cavity of the cart and are held therein by the straps provided on the cart. When the materials handling apparatus of the present invention is configured in this manner, it serves as a conventional trash can which can be covered by the compactor lid having its support members in the extended position. When the bag is filled, the compaction lid is removed and the straps of the cart are released, the cylinder can then be lifted vertically off of the trash bag to leave the bag on the cart for transport to a suitable disposal site thus eliminating the prior art need for lifting a filled bag out of a supporting can and carrying it to the disposal site.

In the second operational mode the conical cylinder is placed within the trash bag with the bag being held on the cylinder by the elastic band. As in the first operational mode, the conical cylinder and the trash bag are held in place in the semi-circular cavity of the cart by the straps provided on the cart. When the materials handling apparatus of the present invention is configured in this manner it is intended for use in handling difficult trash such as tree and shrub clippings, rose bush trimmings and any other refuse which could tear the trash bag. During loading, the compaction lid with its extensible members in the retracted position can be pushed down into the bag for compacting the contents thereof. When the contents are tree and shrub clippings, the compaction lid can be rotated while being pushed down which will cause an interweaving of the clippings into a compact mass similar to a birds nest for ease of handling.

In the third operational mode, the conical cylinder is placed in the wheeled cart and no trash bag is used. The waste material at a site being cleaned up is loaded directly into the conical cylinder and can be compacted in the manner described above. When the site clean-up is completed, the cart can be moved to a disposal site and lifting of the conical cylinder will expose the waste materials for direct deposit into the disposal site and a suitable tool, such as a pitchfork can be used if needed.

Accordingly, it is an object of the present invention to provide a new and useful materials handling apparatus for aiding the loading of various materials, especially waste materials, into trash bags and transporting them between different pickup sites and ultimately to a suitable disposal site.

The foregoing object of the present invention as well as the invention itself will be more fully understood from the following description when read in conjunction with the accompanying drawings.

BRIEF DESCRIPTION OF THE DRAWINGS

FIG. 1 is a perspective view of the materials handling apparatus of the present invention showing the relationship of the various elements of the apparatus when in its first operational mode.

FIG. 2 is an exploded view of the materials handling apparatus showing the parts relationship of the apparatus when in its second operational mode.

DESCRIPTION OF THE PREFERRED EMBODIMENT

Figure 3:
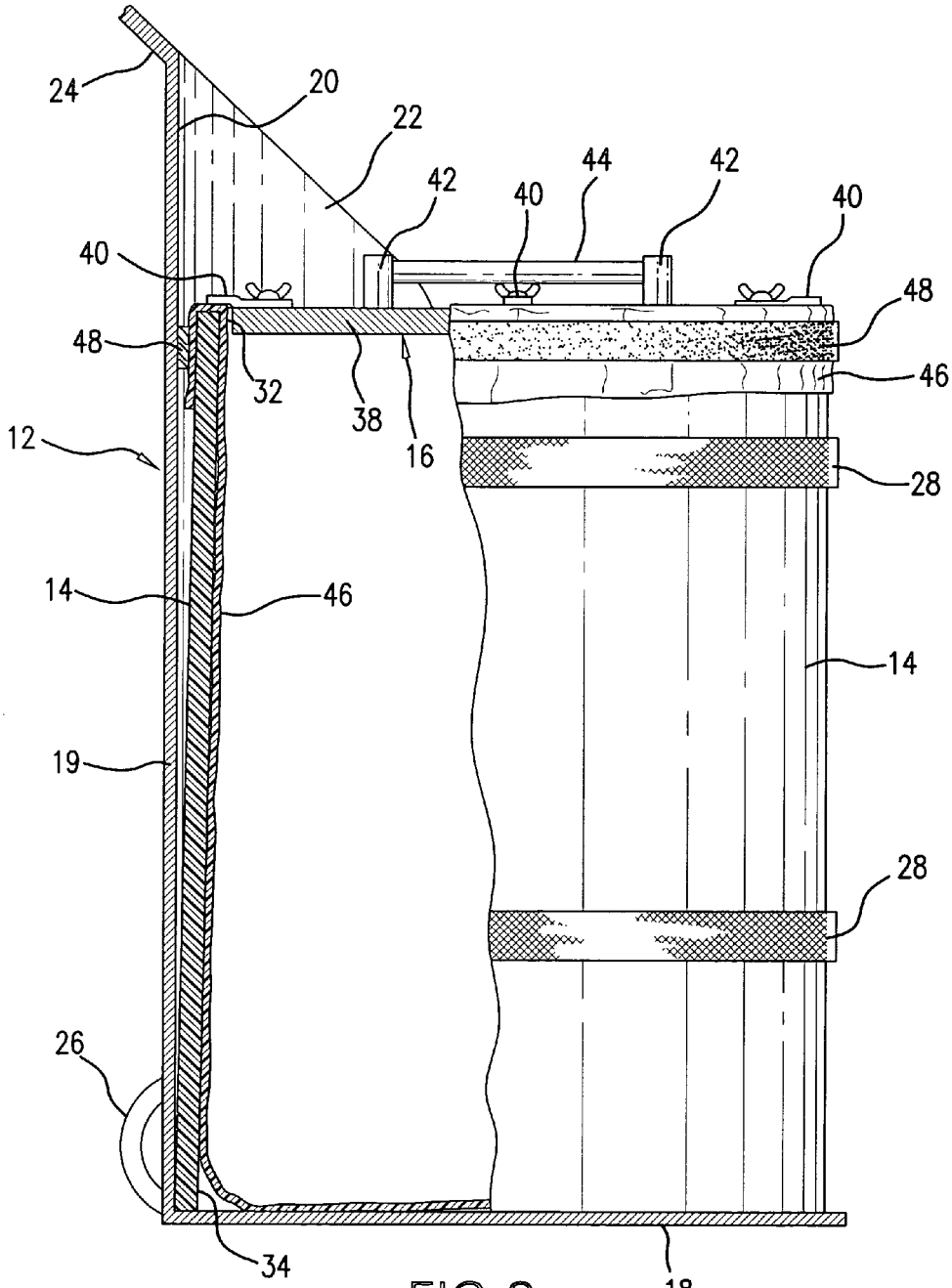
FIG. 3 is an enlarged side elevational view of the materials handling apparatus shown in FIG. 1 and partially broken away to more clearly show the relationship of the various elements of the apparatus when in its first operational mode.

Referring more particularly to the drawings, FIG. 1 shows the materials handling apparatus of the present invention which is indicated in its entirety by the reference numeral 10. The apparatus 10 has three major components, a wheeled cart 12, a truncated conical cylinder 14 and a compaction lid 16.

As seen best in FIG. 2, the wheeled cart 12 has a base platform 18 from which a body 19 having a semi-circular in cross-section cavity 20 extends upwardly with the body having an open top 22. A handle 24 extends angularly from the open top 22 of the body 19, and a pair of wheels 26 (one shown) are provided adjacent the base platform 18 of the cart 12. The cart 12 is further provided with a pair of straps 28 each of which has its proximal end (not shown) fixedly attached to the cart 12 and each having a distal end 29. A pair of hook and loop fasteners 30 are provided on the cart 12 and on the distal ends 29 of the straps 28.

The truncated conical cylinder 14 has an open top 32 and bottom 34 with the top having a circumference which is approximately 95% as large as the circumference of the bottom. That is, the circumference of the top 32 is approximately 5% smaller than the circumference of the bottom 34. The cylinder 14 is provided with a pair of handles 36 for lifting of the cylinder.

Figure 5:
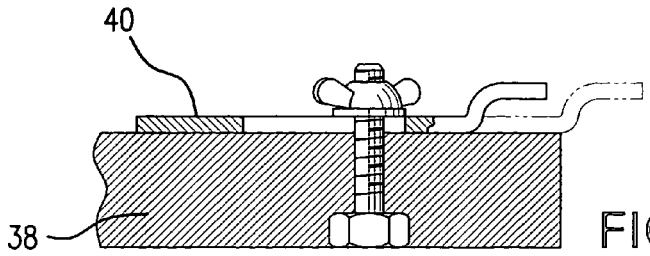
FIG. 5 is an enlarged fragmentary sectional view taken along the line 5-5 in FIG. 4 and showing one of the extensible members of the compaction lid of the materials handling apparatus.

The compaction lid 16 has a circular body 38 with a plurality of extensible members 40 mounted on the upper surface thereof. A typical one of the extensible members 40 is seen in FIG. 5, as being movable between a retracted position shown in solid lines and an extended position shown in dotted lines. Handle means in the illustrated form of a pair of stanchions 42 are mounted on the upper surface of the body 38 in a parallel spaced apart relationship and a spaced apart pair of bars 44 extending there between. The stanchions 42 support the bars 44 in an upwardly spaced position above the upper surface of the body 38 so that a person can grasp the bars 44 for manipulation of the compaction lid 16.

The above described major components provide the apparatus 10 with the capability of being operated in three different modes for aiding in the collection of various materials, especially waste materials, and transporting them between different pickup sites and ultimately to a suitable disposal site. In the first two operational modes, the collected materials are loaded into trash bags, such as the bag shown at reference numeral 46 in FIG. 2, and in the third mode, the materials are loaded directly into the conical cylinder 14.

In a first one of the operational modes the trash bag 46, as best seen in FIG. 3, is placed inside the conical cylinder 14 with its upper end folded over the rim which circumscribes the open top 32 of the cylinder and the bag is held in place by an elastic band 48. The conical cylinder 14 and the trash bag 46 are positioned within the semi-circular cavity 20 formed in the body 19 of the wheeled cart 12 and are held therein by the straps 28 provided on the cart. When the materials handling apparatus 10 is used in this manner, it serves as a conventional trash can which can be covered by the compaction lid 16 having its extensible members 40 in the extended position to support the lid in the open top 32 of the conical cylinder 14. When the trash bag 46 is filled, the compaction lid 16 and the elastic band 48 are removed and the straps 28 of the cart 12 are released, the conical cylinder 14 can then be lifted vertically off of the trash bag 46 to leave the bag on the cart for transport to a suitable disposal site thus eliminating the prior art need for lifting a filled bag out of a supporting can and carrying it to the disposal site.

Figure 4:
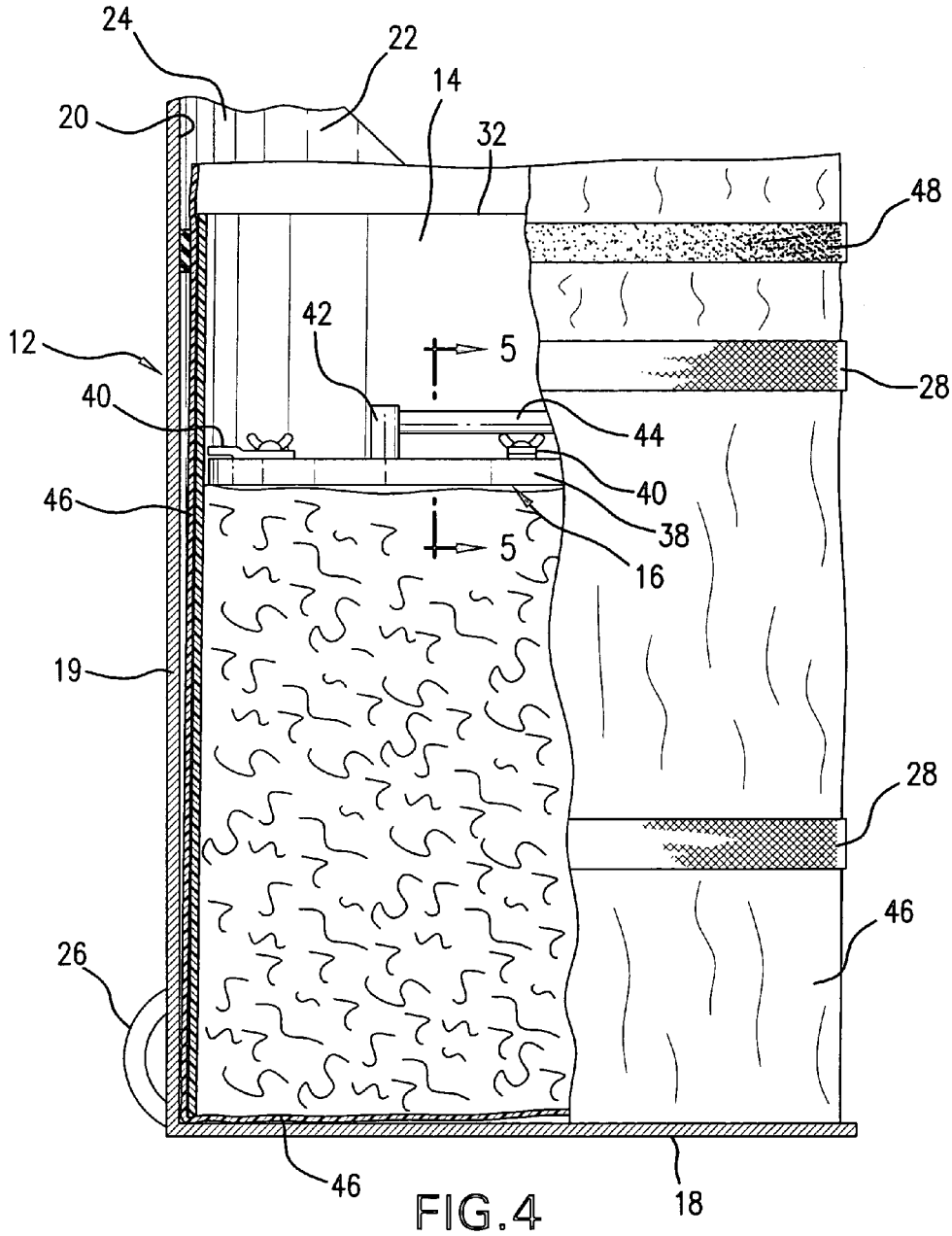
FIG. 4 is a side elevational view similar to FIG. 3 but showing the relationship of the various elements of the materials handling apparatus when in its second operational mode.

In the second operational mode the conical cylinder 14 is placed inside the trash bag 46 as seen in FIGS. 2 and 4 with the bag being held in place by the elastic band 48. As in the first mode, the conical cylinder 14 and the trash bag 46 are held in place in the cavity 20 of the body 19 of the cart 12 by the straps 28 provided on the cart. When the apparatus 10 is used in this manner it is intended for use in handling difficult trash such as tree and shrub clippings, rose bush trimmings and any other refuse which could tear the trash bag 46. During loading, the compaction lid 16 with its extensible members 40 in the retracted position can be pushed down into the bag for compacting the contents thereof. When the contents are tree and shrub clippings, the compaction lid 16 can be rotated while being pushed down which will cause an interweaving of the clippings into a compact mass similar to a birds nest for ease of handling. When the trash bag 46 is filled, with the elastic band 48 removed and the straps 28 of the cart 12 released, the conical cylinder 14 can then be lifted up out of the trash bag by a user grasping the handles 36 thereof and gently shaking the cylinder while exerting an upwardly lifting force. This will leave the trash bag ready for being deposited at the disposal site.

In the third operational mode, the conical cylinder 14 is placed in the wheeled cart 12 in the manner described above and no trash bag is used. The waste material at a site being cleaned up is loaded directly into the conical cylinder 14 and can be compacted in the manner described above. When the site clean-up is completed, the cart 12 can be moved to a disposal site where the straps 28 are released and lifting of the conical cylinder 14 will expose the waste materials for deposit into the disposal site and a tool, such as a pitchfork (not shown) can be used if needed.

While the principles of the invention have now been clear in illustrated embodiments, many modifications will be obvious to those skilled in the art which do not depart from those principles. The appended claims are therefore intended to cover such modifications within the limits only of the true spirit and scope of the invention.

What I claim is:

1. A materials handling apparatus comprising:

a) a wheeled cart having a base platform from which a body extends upwardly with said body having a longitudinally extending semi-circular in cross-section cavity formed therein with the cavity being open at the top;

b) a trash bag;

c) a truncated conical cylinder positioned inside said trash bag for receiving the materials to be handled, said conical cylinder having an open top and an open bottom and being removably positioned in the cavity formed in said cart; and d) a compaction lid for placement within the open top of said conical cylinder, wherein said compaction lid comprises:

i) a circular body having an upper surface;

ii) handle means affixed to the upper surface of said circular body; and iii) a plurality of extensible members on said circular body, each of said extensible members having an extended position for engaging the rim of said conical cylinder to support said lid in the open top of said conical cylinder and having a retracted position which allows said compaction lid to be moved down into said conical cylinder to compact the materials.

2. A materials handling apparatus as claimed in claim 1 and further comprising an elastic band on said trash bag for releasably holding said trash bag on said conical cylinder.

3. A materials handling apparatus as claimed in claim 1 and further comprising:

a) a pair of straps mounted on said cart for releasably holding said conical cylinder and said trash bag in the cavity formed in the body of said cart, each of said pair of straps having a distal end; and b) a pair of hook and loop fasteners each associated with a different one of said pair of straps, each of said hook and loop fasteners having one half thereof on said cart and the other half on the distal end of its associated one of said pair of straps.

4. A materials handling apparatus as claimed in claim 1 and further comprising said conical cylinder having a pair of handles by which said conical cylinder can be lifted up out of the said trash bag when said conical cylinder has been loaded with the materials to be handled and said elastic band has been removed and said pair of straps have been released.

5. A materials handling apparatus as claimed in claim 1 wherein the materials to be handled by said apparatus are waste materials.

* * * * *